US009068460B2

(12) United States Patent
Suciu et al.

(10) Patent No.: US 9,068,460 B2
(45) Date of Patent: Jun. 30, 2015

(54) INTEGRATED INLET VANE AND STRUT

(75) Inventors: Gabriel L. Suciu, Glastonbury, CT (US); Brian D. Merry, Andover, CT (US); Lisa I. Brilliant, Middletown, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 624 days.

(21) Appl. No.: 13/435,134

(22) Filed: Mar. 30, 2012

(65) Prior Publication Data

US 2013/0259672 A1 Oct. 3, 2013

(51) Int. Cl.
*F01D 1/04* (2006.01)
*F01D 9/02* (2006.01)

(52) U.S. Cl.
CPC .... *F01D 1/04* (2013.01); *F01D 9/02* (2013.01)

(58) Field of Classification Search
CPC ..... F01D 9/02; F01D 1/04
USPC ..... 415/115, 142, 175
See application file for complete search history.

(56) References Cited

U.S. PATENT DOCUMENTS

| | | | | |
|---|---|---|---|---|
| 4,369,016 | A | 1/1983 | Dennison | |
| 4,478,551 | A * | 10/1984 | Honeycutt et al. | 415/142 |
| 4,624,104 | A | 11/1986 | Stroem | |
| 4,720,235 | A | 1/1988 | Lachance et al. | |
| 4,793,770 | A | 12/1988 | Schonewald et al. | |
| 4,979,872 | A * | 12/1990 | Myers et al. | 415/142 |
| 4,989,406 | A | 2/1991 | Vdoviak et al. | |
| 5,080,555 | A * | 1/1992 | Kempinger | 415/142 |
| 5,494,301 | A | 2/1996 | Hamilton et al. | |
| 6,045,325 | A | 4/2000 | Horvath et al. | |
| 6,082,966 | A * | 7/2000 | Hall et al. | 415/209.1 |
| 6,884,024 | B2 | 4/2005 | Boeck et al. | |
| 7,124,572 | B2 * | 10/2006 | Aycock et al. | 60/39.511 |
| 7,549,839 | B2 | 6/2009 | Carroll et al. | |
| 7,739,865 | B2 | 6/2010 | Prasad et al. | |
| 7,955,046 | B2 | 6/2011 | McCune et al. | |
| 2006/0275110 | A1 * | 12/2006 | Baralon | 415/191 |
| 2006/0288686 | A1 * | 12/2006 | Cherry et al. | 60/226.1 |
| 2009/0056306 | A1 | 3/2009 | Suciu et al. | |
| 2009/0220330 | A1 * | 9/2009 | Henry et al. | 415/111 |
| 2010/0068034 | A1 | 3/2010 | Schiavo et al. | |
| 2010/0105516 | A1 * | 4/2010 | Sheridan et al. | 475/346 |

(Continued)

OTHER PUBLICATIONS

International Search Report and Written Opinion for International Application No. PCT/US2013/033241 completed on Feb. 6, 2014.

(Continued)

*Primary Examiner* — Edward Look
*Assistant Examiner* — Aaron R Eastman
(74) *Attorney, Agent, or Firm* — Carlson, Gaskey & Olds, P.C.

(57) ABSTRACT

A gas turbine engine case structure includes inner and outer annular case portions radially spaced from one another to provide a flow path and circumferentially arranged airfoils extend radially and interconnect the inner and outer annular case portions. The airfoils include multiple vanes and multiple strut-vanes. Each vane has a vane leading edge. Each strut-vane includes a strut-vane leading edge. The vane leading edges and strut-vane leading edges are aligned in a common plane. The vanes include a first axial length and the strut-vanes include a second axial length that is at least double the first axial length.

20 Claims, 3 Drawing Sheets

(56) References Cited

U.S. PATENT DOCUMENTS

| | | | | |
|---|---|---|---|---|
| 2010/0132369 | A1* | 6/2010 | Durocher et al. | 60/796 |
| 2010/0307165 | A1* | 12/2010 | Wong et al. | 60/796 |

OTHER PUBLICATIONS

International Preliminary Report on Patentability for PCT Application No. PCT/US2013/033241, mailed Oct. 9, 2014.

* cited by examiner

INTEGRATED INLET VANE AND STRUT

BACKGROUND

This disclosure relates to a gas turbine engine case structure.

A static structure for a gas turbine engine includes multiple case structures defining a core flow path. In one type of gas turbine engine, an inlet case structure is arranged upstream from a low pressure compressor section, and an intermediate case structure is arranged downstream from the low pressure compressor section and immediately upstream from the high pressure compressor section.

One or more of these case structures may include multiple circumferentially arranged vanes and struts axially spaced and discrete from one another. An example inlet case 130 receiving a core flowpath C is schematically illustrated in FIG. 4. The inlet case 130 includes a circumferential array of inlet vanes 132 and multiple circumferentially spaced struts 134. The inlet vanes 132 each include a trailing edge 136 that is axially spaced from a leading edge 138 of each strut 134 to provide an axial gap 142 between the inlet vanes 132 and struts 134. Typically, one or more of the struts 134 are hollow to accommodate the passage of a component 140, such as a lubrication conduit, through the inlet case 130. Although an inlet case 130 is illustrated in FIG. 4, some intermediate cases may include a similar arrangement of inlet vanes and struts. The geometry and positioning of the inlet vanes and struts contribute to the axial length of the case structure.

SUMMARY

In one exemplary embodiment, a gas turbine engine case structure includes inner and outer annular case portions radially spaced from one another to provide a flow path and circumferentially arranged airfoils extend radially and interconnect the inner and outer annular case portions. The airfoils include multiple vanes and multiple strut-vanes. Each vane has a vane leading edge. Each strut-vane includes a strut-vane leading edge. The vane leading edges and strut-vane leading edges are aligned in a common plane. The vanes include a first axial length and the strut-vanes include a second axial length that is greater than the first axial length.

In a further embodiment of any of the above, the vanes have solid cross-sections without hollow cavities.

In a further embodiment of any of the above, the number of vanes is in the range of 40 to 120.

In a further embodiment of any of the above, the number of strut-vanes is in the range of 6 to 14.

In a further embodiment of any of the above, the case structure provides an inlet case that is configured to be arranged upstream from a low pressure compressor section.

In a further embodiment of any of the above, the case structure provides an intermediate case that is configured to be arranged downstream from a low pressure compressor section.

In a further embodiment of any of the above, the vanes each include a trailing edge and an airfoil curvature. An inlet angle and an outlet angle respectively intersect the leading and trailing edges and intersect one another to provide the airfoil curvature.

In a further embodiment of any of the above, airfoil curvature of vanes are adjacent to the strut-vane are different than other vanes.

In a further embodiment of any of the above, some of the outlet angles amongst the vanes differ from one another.

In a further embodiment of any of the above, the strut-vane includes a strut-vane inlet angle that is generally the same as the inlet angle of the vanes.

In a further embodiment of any of the above, at least one strut-vane includes a radial cavity that extends through the inner and outer annular case portions and is configured to accommodate a component there through.

In a further embodiment of any of the above, the leading edges of the vanes and strut-vanes are spaced substantially equally apart.

In a further embodiment of any of the above, the strut-vanes include a vane portion integral with a strut portion. The vane portion includes the strut-vane leading edge, and the strut portion includes lateral sides that taper rearward in an axial direction to a strut trailing edge. A concavity is provided in the one of the lateral sides at a pressure side of the vane portion.

In a further embodiment of any of the above, the lateral sides are symmetrical with one another along the axial direction.

In a further embodiment of any of the above, the second axial length is at least double the first axial length.

In one exemplary embodiment, a gas turbine engine includes a case structure that includes inner and outer annular case portions that are radially spaced from one another to provide a flow path. Circumferentially arranged airfoils extend radially and interconnect the inner and outer annular case portions. The airfoils include multiple vanes and multiple strut-vanes. Each vane has a vane leading edge. Each strut-vane includes a strut-vane leading edge. The vane leading edges and strut-vane leading edges are aligned in a common plane. At least one strut-vane includes a radial cavity that extends through the inner and outer annular case portions and is configured to accommodate a component there through. A low pressure compressor section is arranged adjacent to the case structure.

In a further embodiment of any of the above, the case structure provides an inlet case arranged upstream from the low pressure compressor section.

In a further embodiment of any of the above, the case structure provides an intermediate case arranged downstream from the low pressure compressor section In a further embodiment of any of the above, comprising a fan section arranged upstream from the case structure and the low pressure compressor section.

In a further embodiment of any of the above, a geared architecture coupling the fan section a low speed spool that supports the low pressure compressor section, and a lubrication conduit extends through the strut-vane to a gear compartment arranged about the geared architecture.

In a further embodiment of any of the above, a low speed spool supporting the low pressure compressor section, the low speed spool supported by a bearing arranged in a bearing compartment, and a lubrication conduit extends through the strut-vane to the bearing compartment.

BRIEF DESCRIPTION OF THE DRAWINGS

The disclosure can be further understood by reference to the following detailed description when considered in connection with the accompanying drawings wherein.

DETAILED DESCRIPTION

Figure 1:
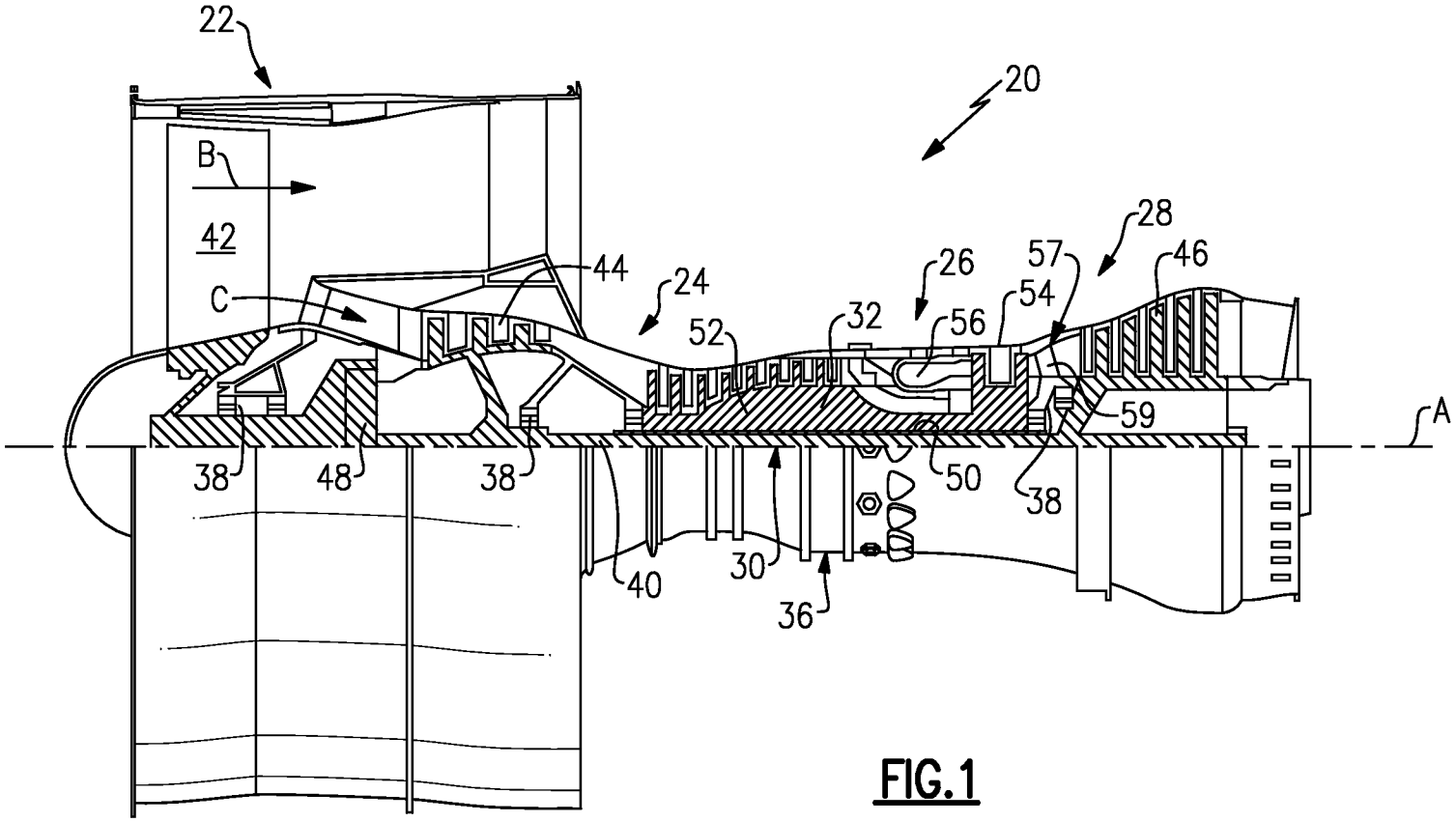
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure (or first) compressor section 44 and a low pressure (or first) turbine section 46. The inner shaft 40 is connected to the fan 42 through a geared architecture 48 to drive the fan 42 at a lower speed than the low speed spool 30. The high speed spool 32 includes an outer shaft 50 that interconnects a high pressure (or second) compressor section 52 and high pressure (or second) turbine section 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes. As used herein, a "high pressure" compressor or turbine experiences a higher pressure than a corresponding "low pressure" compressor or turbine.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a star gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned per hour divided by lbf of thrust the engine produces at that minimum point. "Fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tambient deg R)/518.7)^0.5]. The "Low corrected fan tip speed" as disclosed herein according to one non-limiting embodiment is less than about 1150 ft/second.

Figure 2:
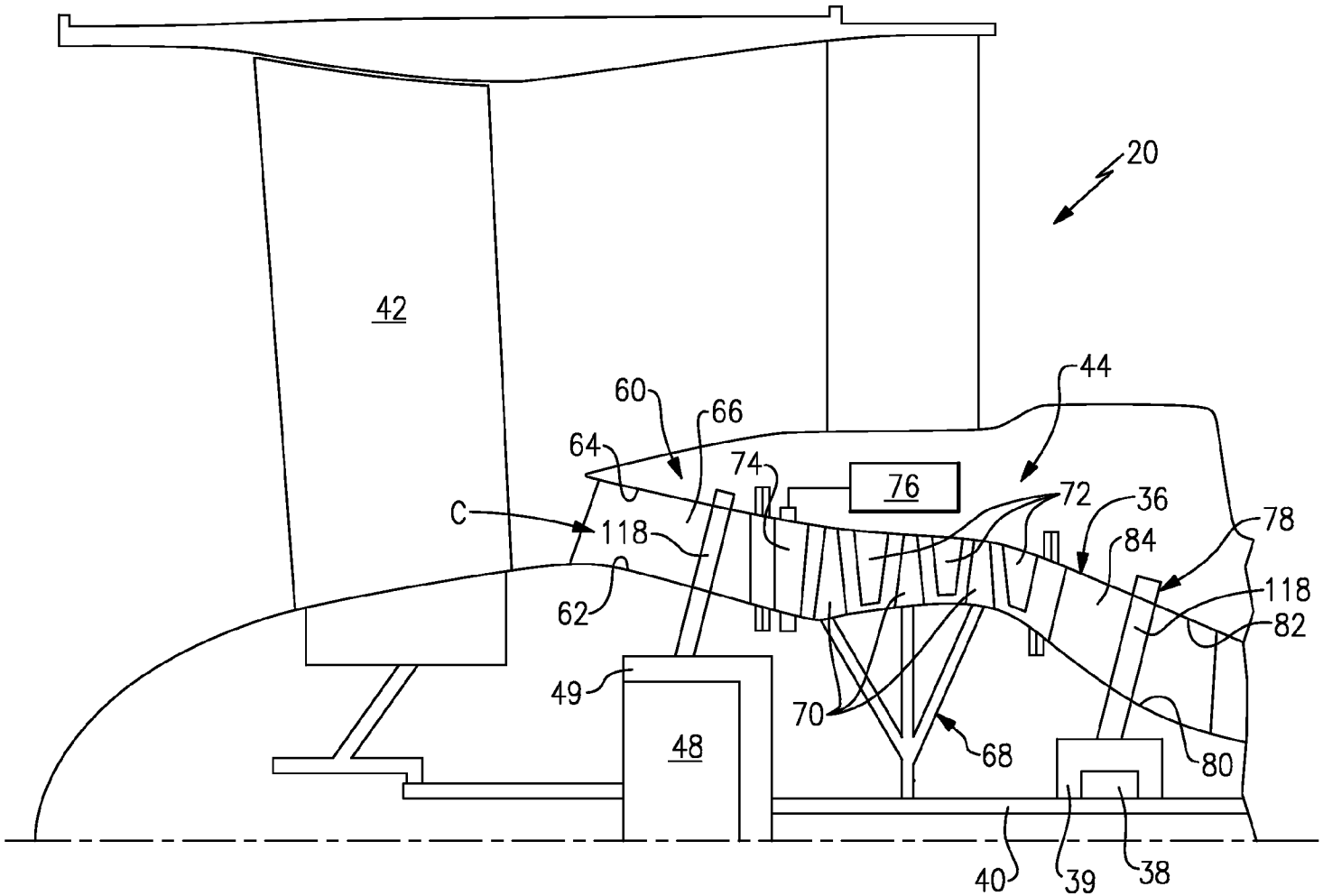
FIG. 2 is an enlarged schematic view of a front architecture of the gas turbine engine illustrated in FIG. 1.

The front architecture of the engine 20 is shown in more detail in FIG. 2. The static structure 36 includes an inlet case 60 having inner and outer inlet case portions 62, 64, which are annular in shape. Circumferentially arranged inlet airfoils 66 interconnect the inner and outer inlet case portions 62, 64. The inlet case 60, which provides a portion of the core flowpath C, is arranged upstream from the low pressure compressor section 44.

A gear compartment 49 encloses the geared architecture 48, which is arranged radially inward of the inlet case 60. A lubrication conduit 118 extends through the inlet case 60 to the gear compartment 49.

The low pressure compressor section 44 includes a low pressure compressor rotor 68 mounted on the low spool 40. The low pressure compressor rotor 68 includes one or more stages of low pressure compressor stages 70. One or more vane stages 72 may be arranged between the stages 70 and supported by the static structure 36. In one example, a variable inlet vane stage 74 is arranged immediately adjacent to the inlet case 60. The stage of variable inlet vanes 74 is rotated about radial axes by an actuator 76.

An intermediate case 78, which provides a portion of the core flowpath C, is arranged downstream from the low pressure compressor section 44. The intermediate case 78 includes annular inner and outer intermediate case portions 80, 82 radially spaced from one another. Circumferentially arranged intermediate airfoils 84 interconnect the inner and outer intermediate case portions 80, 82.

The low spool 40 is supported by the bearing 38 relative to the static structure 36. The bearing 38 is arranged in a bearing compartment 39. In one example, the bearing compartment 39 is arranged radially inward of the intermediate case 78, and a lubrication conduit 118 extend through the intermediate case 78 to the bearing compartment.

Figure 3:
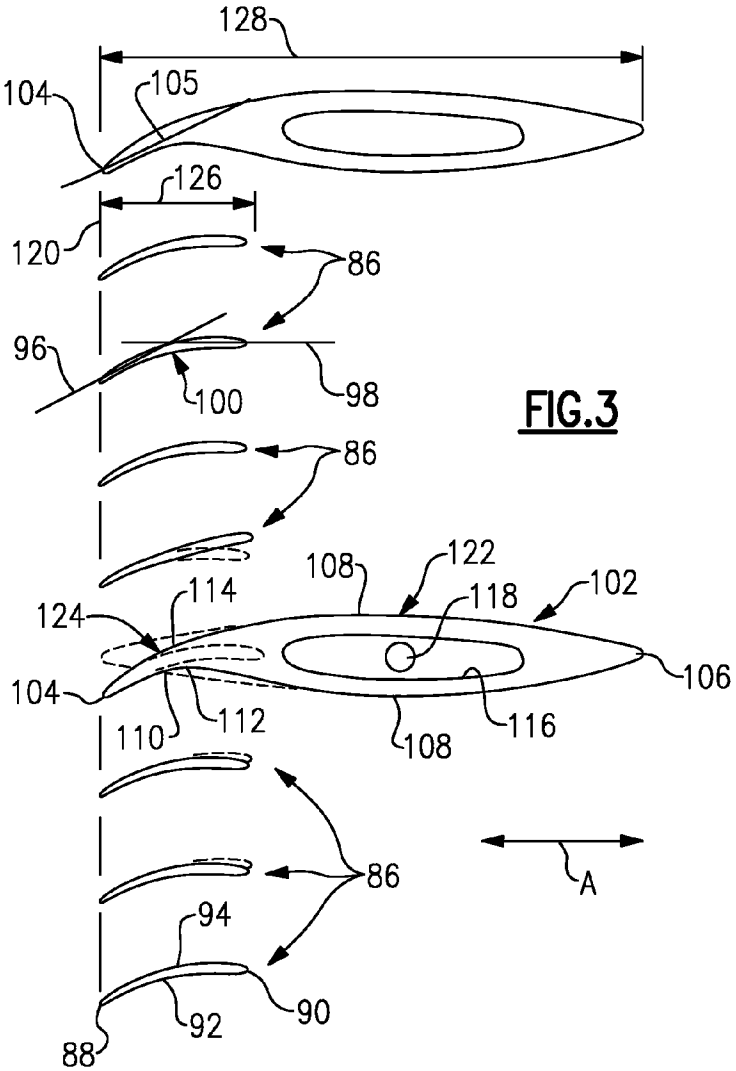
FIG. 3 is a plan view of an example arrangement of vanes and strut-vanes for an inlet case and/or an intermediate case illustrated in FIG. 2.
Figure 4:
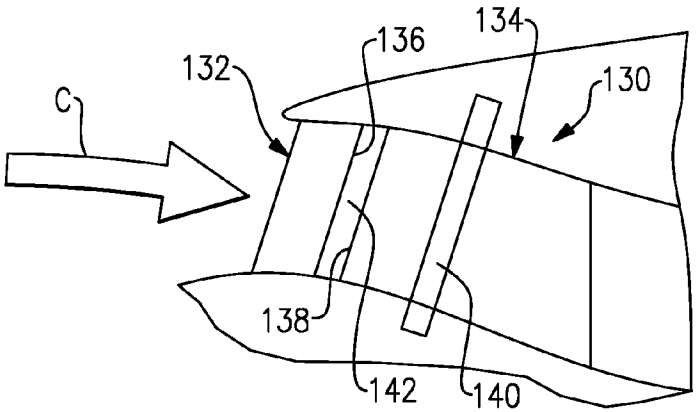
FIG.4 Related Art
FIG. 4 is an enlarged view of a RELATED ART inlet case.

Referring to FIG. 3, at least some of the previously discrete circumferential arrays of vanes and struts are integrated with one another in an example case structure. Multiple circumferentially arranged airfoils are provided by vanes 86 (shown in a plan view) that include axially spaced apart leading and trailing edges 88, 90. The vanes 86 include pressure and suction sides 92, 94 spaced apart from one another and joining the leading and trailing edges 88, 90. Each vane 86 provides an airfoil curvature 100 that is defined, in part, by inlet and outlet angles 96, 98 that intersect one another and the leading and trailing edges 88, 90, respectively. In one example, the vanes 86 have solid cross-sections without hollow cavities.

A case structure also includes a strut-vane 102, which is a strut and vane integrated with one another, which reduces the axial length of the case structure. The dashed lines illustrate the typical shapes of non-integrated vanes and struts in the integrated areas. The vanes 86 extend axially a first axial length 126, and the strut-vanes 102 extend a second axial length 128 that is at least double the first axial length 126, for example. A given gas turbine engine application may have forty to one hundred-twenty vanes 86 and six to fourteen strut-vanes.

The strut-vane 102 includes a vane portion 124 integral with a strut portion 122. The vane portion 124 provides a leading edge 104, which is arranged in the same plane 120 as the leading edges 88 of the vanes 86. In one example, the leading edges 88, 104 are circumferentially spaced substantially equally apart. The vane portion 124 includes a strut-vane inlet angle 105 that intersects the leading edge 104. The inlet angle 96 and the strut-vane inlet angle 105 are substantially the same as one another.

The strut portion 122 extends in a generally axial direction. The strut portion 122 includes lateral sides 108 that are symmetrical with one another and join at a trailing edge 106. A radially extending cavity 116 is provides in at least one strut portion 122 to accommodate a component 118, such as a lubrication conduit extending through the case structure.

The strut-vane 102 includes pressure and suction sides 112, 114. A concavity 110 in one of the lateral sides 108 of the strut portion 122 transitions to the pressure side 112 of the vane portion 124.

The airfoil curvatures 100 of vanes 86 adjacent to each strut-vane 102 are different than other vanes to equalize the flow and minimize the flow variation through the vanes 86, in particular in the area of the strut-vanes 102. In one example, as illustrated by the dashed lines, the outlet angles 98 and location of the trailing edges 90 of adjacent vanes 86 to the strut vanes 102 may be varied.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine case structure comprising:

inner and outer annular case portions radially spaced from one another to provide a flow path;

circumferentially arranged airfoils extending radially and interconnecting the inner and outer annular case portions, the airfoils including multiple vanes and multiple strut-vanes, each vane having a vane leading edge, each strut-vane including a strut-vane leading edge, the vane leading edges and strut-vane leading edges aligned in a common plane, wherein the vanes include a first axial length and the strut-vanes includes a second axial length that is greater than the first axial length; and the leading edges of the vanes and strut-vanes are spaced equally apart.

2. The gas turbine engine case structure according to claim 1, wherein the vanes have solid cross-sections without hollow cavities.

3. The gas turbine engine case structure according to claim 1, wherein the number of vanes is in the range of 40 to 120.

4. The gas turbine engine case structure according to claim 1, wherein the number of strut-vanes is in the range of 6 to 14.

5. The gas turbine engine case structure according to claim 1, wherein the case structure provides an inlet case configured to be arranged upstream from a low pressure compressor section.

6. The gas turbine engine case structure according to claim 1, wherein the case structure provides an intermediate case configured to be arranged downstream from a low pressure compressor section.

7. The gas turbine engine case structure according to claim 1, wherein the vanes each include a trailing edge and an airfoil curvature, and an inlet angle and an outlet angle respectively intersect the leading and trailing edges and intersect one another to provide the airfoil curvature.

8. The gas turbine engine case structure according to claim 7, wherein airfoil curvature of vanes adjacent to the strut-vane are different than other vanes.

9. The gas turbine engine case structure according to claim 8, wherein some of the outlet angles amongst the vanes differ from one another.

10. The gas turbine engine case structure according to claim 7, wherein the strut-vane includes a strut-vane inlet angle that is generally the same as the inlet angle of the vanes.

11. The gas turbine engine case structure according to claim 1, at least one strut-vane including a radial cavity extending through the inner and outer annular case portions and configured to accommodate a component there through.

12. The gas turbine engine case structure according to claim 1, wherein the strut-vanes includes a vane portion integral with a strut portion, the vane portion includes the strut-vane leading edge, and the strut portion includes lateral sides tapering rearward in an axial direction to a strut trailing edge, and a concavity is provided in the one of the lateral sides at a pressure side of the vane portion.

13. The gas turbine engine case structure according to claim 12, wherein the lateral sides include portions that are symmetrical with one another along the axial direction.

14. The gas turbine engine case structure according to claim 1, wherein the second axial length is at least double the first axial length.

15. A gas turbine engine comprising:

a case structure including inner and outer annular case portions radially spaced from one another to provide a flow path;

circumferentially arranged airfoils extending radially and interconnecting the inner and outer annular case portions, the airfoils including multiple vanes and multiple strut-vanes, each vane having a vane leading edge, each strut-vane including a strut-vane leading edge, the vane leading edges and strut-vane leading edges aligned in a common plane, at least one strut-vane including a radial cavity extending through the inner and outer annular case portions and configured to accommodate a component there through, the leading edges of the vanes and strut-vanes are spaced equally apart; and a low pressure compressor section arranged adjacent to the case structure.

16. The gas turbine engine according to claim 15, wherein the case structure provides an inlet case arranged upstream from the low pressure compressor section.

17. The gas turbine engine case structure according to claim 15, wherein the case structure provides an intermediate case arranged downstream from the low pressure compressor section.

18. The gas turbine engine according to claim 15, comprising a fan section arranged upstream from the case structure and the low pressure compressor section.

19. The gas turbine engine according to claim 18, comprising a geared architecture coupling the fan section a low speed spool that supports the low pressure compressor section, and a lubrication conduit extends through the strut-vane to a gear compartment arranged about the geared architecture.

20. The gas turbine engine according to claim 15, comprising a low speed spool supporting the low pressure compressor section, the low speed spool supported by a bearing arranged in a bearing compartment, and a lubrication conduit extends through the strut-vane to the bearing compartment.

* * * * *